United States Patent [19]

Law

[11] Patent Number: 4,543,687

[45] Date of Patent: Oct. 1, 1985

[54] TAPERED NESTING HINGE

[75] Inventor: David Law, Whangaparaoa, New Zealand

[73] Assignee: Development Finance Corporation of New Zealand, Auckland, New Zealand

[21] Appl. No.: 523,283

[22] Filed: Aug. 15, 1983

[30] Foreign Application Priority Data

Aug. 27, 1982 [NZ] New Zealand ..... 201749

[51] Int. Cl.[4] ..... E05D 5/02

[52] U.S. Cl. ..... 16/388; 16/387; 16/DIG. 29

[58] Field of Search ..... 16/387, 388, DIG. 29

[56] References Cited

U.S. PATENT DOCUMENTS

| | | | |
|---|---|---|---|
| 95,808 | 10/1869 | Killam | 16/387 |
| 376,597 | 1/1888 | Hoffman | 16/387 X |
| 396,660 | 1/1889 | Luce | 16/387 |
| 780,136 | 1/1905 | Sloan . | |
| 1,676,541 | 7/1928 | Friedman . | |
| 4,237,577 | 12/1980 | Chapel . | |

FOREIGN PATENT DOCUMENTS

| | | | |
|---|---|---|---|
| 608149 | 11/1960 | Canada | 16/DIG. 29 |
| 820864 | 11/1951 | Fed. Rep. of Germany | 16/DIG. 29 |
| 704740 | 5/1931 | France . | |
| 101637 | 5/1949 | New Zealand . | |
| 637282 | 5/1950 | United Kingdom . | |
| 643082 | 9/1950 | United Kingdom | 16/DIG. 29 |

*Primary Examiner*—Fred Silverberg

*Attorney, Agent, or Firm*—Young & Thompson

[57] ABSTRACT

A butt hinge has a pair of tapered leaves connected together by a removable pivot pin, an outer leaf having tubular portions at each end thereof for reception of the pivot pin, and having a central cut out area for reception of an inner leaf having an inner tubular portion for the pivot pin. Locating ribs are provided on opposite sides of the tubular portions, and together with central locating notches they facilitate the location and installation of the hinge on a door and jamb. The tapered overlapping of the leaves avoids the need to provide rebates to receive the hinge, or the need to trim or bevel the edge of the door to prevent binding when the door is closed.

1 Claim, 11 Drawing Figures

FIG. 9
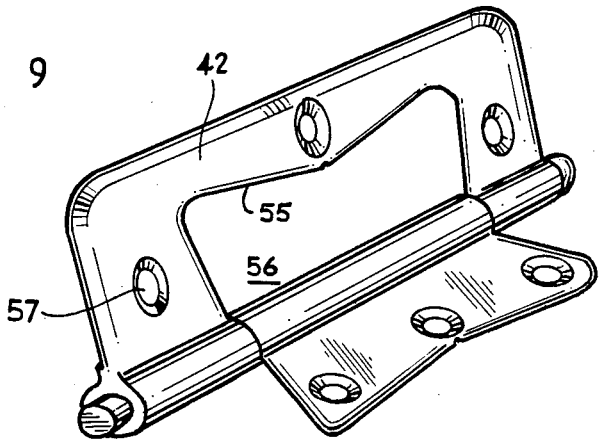
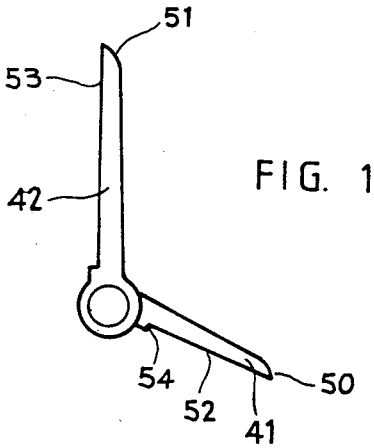
FIG. 10

TAPERED NESTING HINGE

BACKGROUND OF THE INVENTION

This invention relates to hinges, and has particular application to butt hinges for doors or windows.

Butt hinges are generally formed from a pair of substantially rectangular flat metal strips joined together about a pivot axis so that the two or more leaves of the hinge abut one another in face to face contact when the hinge is closed. Such hinges are difficult to locate accurately, requiring precise measurements on both the door and the jamb, and in addition require rebates to be formed in both the door and the jamb to receive the leaves to enable the door to close snugly against the jamb. Nevertheless, it frequently occurs that such fittings require the edge of the door to be trimmed or bevelled to prevent binding when the door is closed.

A significant improvement over this type of butt hinge, has been the provision of a pair of overlapping pivotally connected leaves fitting one within the other to present substantially one leaf thickness when the hinge is closed. This type of hinge is typically formed with an inner leaf nested within an outer or surrounding leaf, with each leaf being of uniform thickness so that when the hinge is closed each leaf lies within the same plane thereby presenting a hinge of only one leaf thickness. Examples of these hinges are shown in New Zealand Pat. No. 101,637 (Hurcal Engineering Company Ltd.) and U.S. Pat. No. 4,237,557 (Chapel). Neither of these constructions overcomes the problem of binding when the door is closed, and thus it is necessary to trim or bevel the edge of the door to prevent binding.

SUMMARY OF THE INVENTION

It is an object of this invention to provide an improved hinge which minimises the tendency of the door to bind against the jamb when the door is closed.

In one aspect, the invention provides a hinge of the type having a pair of overlapping and pivotally connected leaves fitting one within the other to present substantially one leaf thickness when closed, wherein the thickness of the overlapping leaves tapers away from the pivot axis of the hinge.

Other aspects of this invention which should be considered in all its novel aspects, will become apparent from the following description which is given by way of example only, with reference to the accompanying drawings, in which:

FIG. 9 is a perspective view of the hinge of FIG. 6.

FIG. 10 is an end view of FIG. 9

Figure 4:
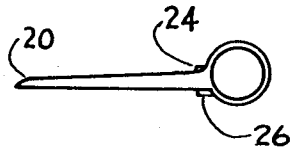
FIG. 4 is a top plan view of the hinge of FIG. 1 when closed.

A first hinge 10 has a pair of leaves 11 and 12 connected to a central pivot pin 13. The leaves 11 and 12 are so formed that the inner leaf 11 fits within outer leaf 12. Leaf 11 has a tubular portion 14, whilst outer leaf 12 has tubular portions 15 and 16 at either end thereof.

Leaf 11 has a bevelled or tapered edge 17 which fits against a corresponding inner tapered edge 18 on outer leaf 12 surrounding the cut out area 19 of leaf 12. By this means, the leaf 11 can fit snugly against the outer leaf 12 in only one orientation.

Figure 3:
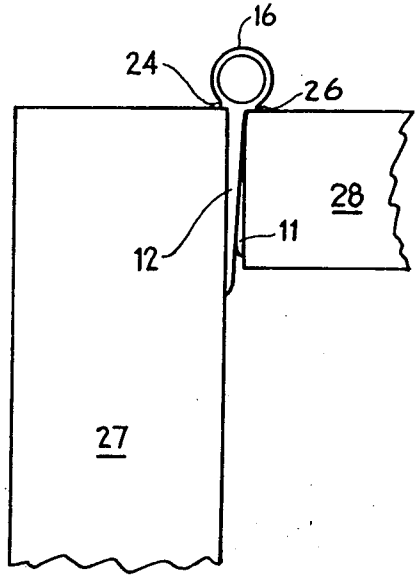
FIG. 3 illustrates the hinge of FIG. 1 in top plan, mounted between a door and door jamb.
Figure 6:
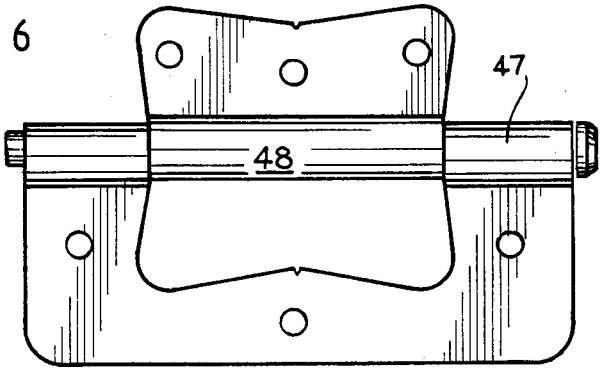
FIG. 6 shows a third hinge in front elevation with the leaves open.
Figure 8:
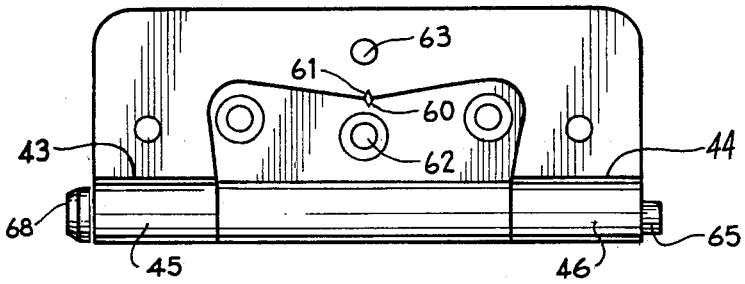
FIG. 8 is a back elevation of the hinge of FIG. 7.
Figure 7:
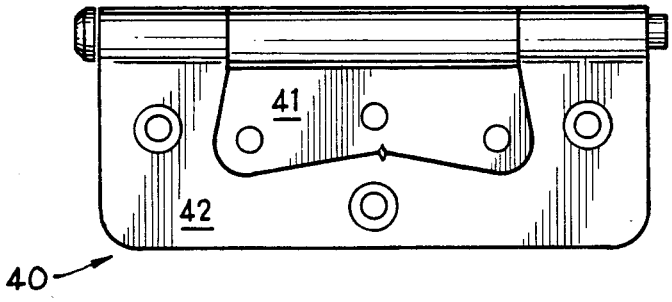
FIG. 7 is a front elevation of the hinge of FIG. 6 with both leaves in the closed position.
Figure 11:
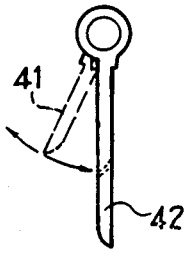
FIG. 11 is an end view of FIG. 7 showing how the inner leaf fits within the outer leaf.

The leaves 11 and 12 lie in substantially the same plane when closed and each leaf is tapered when seen in FIG. 4 or FIG. 3 (e.g. top plan views looking down on a vertically mounted hinge.) The taper is such that the leaves taper away from the tubular portion, and thus are thicker adjacent the tubular portion 16 and thinnest towards their outer edges. In addition, the outermost edge 20 of leaf 12 may also be bevelled or tapered as shown.

Each leaf is provided with a plurality of apertures 22 for screws or the like, so that they may be connected to a door or door jamb, or the like. It will be generally convenient to provide counter sunk apertures for the reception of counter sunk screws or other fasteners.

Figure 2:
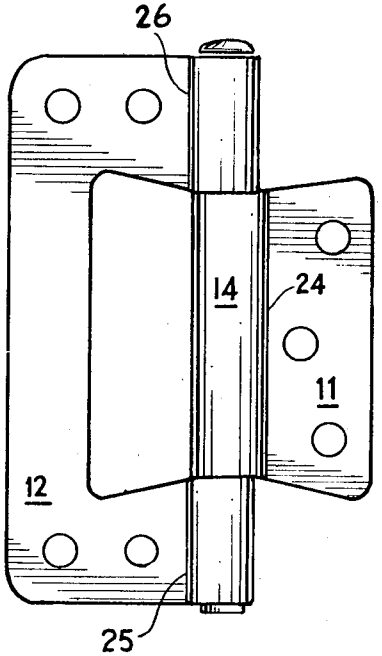
FIG. 2 is a back elevation of the hinge of FIG. 1.

As shown in FIG. 3, it is preferred that the leaves are mounted centrally with respect to the pivot pin 13, and hence the tubular portions 14–16. To assist in locating the hinge on a door or the like, it is preferred that the tubular portions are provided with locating means on opposite sides thereof, as shown in FIGS. 2 and 3. The locating means may be formed by specially shaped tubular portions, or may be formed by ribs or haunches along the edges of the tubular portions. One such locating means 24 lies along the junction between the tubular portion 14 and the rear face of leaf 11. Similarly, locating means 25 and 26 are provided at the junction between the tubular portions 15 and 16 and the rear face of the leaf 12. These are shown in FIG. 2. The rear face is that face of each leaf which fits against the door or jamb.

As the leaves of the hinge lie in substantially the same plane when closed, and the leaves are tapered, the hinge of this invention minimises the risk of a door binding against a door jamb. This can best be appreciated from FIG. 3, as the door 28 when in the closed position against jamb 27 should be positioned with its end square onto the jamb. The rear faces of the leaves each fit against the respective door or jamb (it does not matter which leaf is chosen to fit against the door) and in the position shown in FIG. 3 the rear faces of each leaf are substantially parallel to one another. However, as the leaves are tapered their front faces are not parallel, and thus there is a clearance or nonbinding gap between the front face of one leaf and the rear face of the other leaf. Thus, if for some reason the door or jamb is warped slightly, or the end of the door is not square, this tapered effect will provide a clearance which will tend to minimise binding of the door against the jamb.

Figure 1:
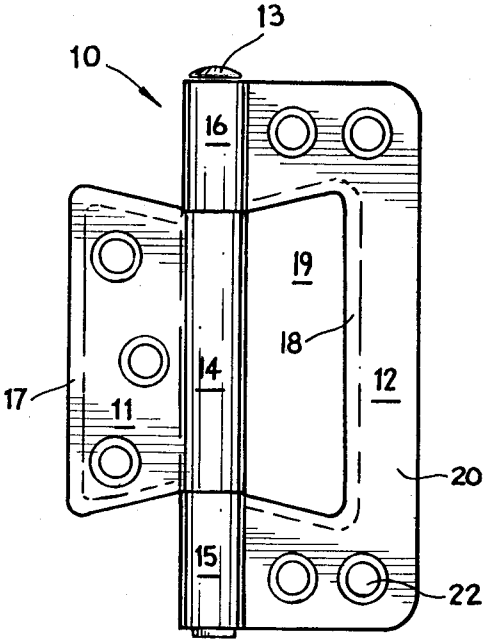
FIG. 1 is a front elevation of a first hinge with the leaves opened at 180 degrees.
Figure 5:
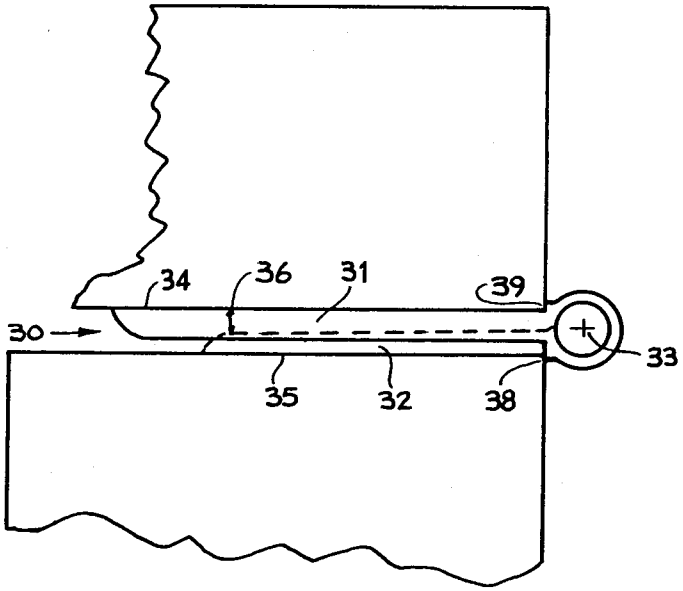
FIG. 5 illustrates a second hinge, in the closed position.

Turning now to FIG. 5, a tapered hinge 30 is shown similar to the hinge of FIG. 1, except that the leaves 31, 32 are offset on either side of the pivot axis 33 and although each leaf may be of uniform thickness throughout (ignoring the cut out area of the outer leaf 31) the offset nature of these leaves will create a tapered effect similar to that of the hinge of FIG. 1. Thus when the rear faces 34, 35 of the leaves are parallel as shown in FIG. 5, there is a non-binding clearance 36. If the door is closed beyond the square position shown, it will be appreciated that the hinge will move into a more tapered configuration taking up the clearance 36.

This hinge has locating means 38, 39 formed as shaped haunches on the respective tubular portions.

Turning now to FIGS. 6 through 10, a third hinge 40 is illustrated. This hinge is similar to the hinge 10 of FIG. 1. It has tapered leaves 40 and 41 and locating means in the form of haunches 43, 44 on the outer tubular portions 45, 46 and haunch 47 on the inner tubular portion 48, on the opposite side from the haunches 43, 44. As shown in FIGS. 9 and 10, each leaf 41, 42 is tapered, and together with outer bevelled edges 50, 51 give the impression that they have flat rear faces 52, 53 each rear face having a substantially sharp abutment 54 created by its respective haunch. The tapered edge 50 of the specially shaped inner leaf 41 corresponds to an appropriately bevelled periphery 55 about the cut out zone 56 of the outer leaf 42. Counter sunk apertures 57 are provided in each leaf for the reception of counter sunk screws or the like.

Preferably, co-operating locating notches 60, 61 are provided on the inner and outer leaves to assist in aligning the leaves during fitting. These notches are conveniently formed about the transverse centre line of the hinge, and thus may fall between the centres of the apertures 62, 63 on the respective leaves.

The leaves are joined together by a pivot pin 65 which preferably has a flat head 68, and is preferably readily removable to facilitate installation.

In use, either leaf may be fitted to a door or jamb, although, for the purpose of the following illustration it will be assumed that the outer or larger leaf 42 is to be fitted to the jamb. The height of the hinge is chosen, and a set square is used to draw an appropriate mark or line on both the door and the jamb. With the hinge disassembled into its three components, the inner leaf 41 can be placed on the edge of the door with the haunch 47 abutting the edge of the door, and the notch 60 aligned with the mark on the door. The three apertures in the leaf 41 can then be used to locate a drill, to drill screw holes in the door. It is preferred that the screw holes are drilled to the side of each aperture away from the pivot axis. Screws are then inserted into the apertures, and the leaf is held firmly in place as the screws are inserted. The drilling of the screw holes to one side of the apertures enables the screws to facilitate the location of the leaf snugly against the edge of the door as the abutment of the haunch against the door will prevent the leaf from moving inwardly with respect to the door, and will thus tend to pull the screws into correct alignment with the apertures. This drilling technique also serves to minimise the tendency of the drill to wander towards the pivot axis, and thus tend to throw the haunch away from the edge of the door.

The outer leaf is now fitted to the jamb, in a similar fashion.

When the other hinges have been fitted to the door and jamb, in a similar fashion, the door can be placed against the jamb, with the central tubular portions fitting within the outer tubular portions of each hinge. The pivot pins can then be inserted, and it will be appreciated that the flat head of the pivot pins facilitates the driving home of each pin, either by impact from a hammer, or by the insertion of a screw driver or the like between the door and jamb and placing the blade of the screw driver on the flat head, e.g. at right angles to the flat head, and then hitting the shaft of the screw driver to force the pin home. Thus the pin can be readily inserted, despite close tolerances between the door and the jamb.

It will also be appreciated that the construction of the hinges shown in the drawings, enables an architrave to be fitted snugly against the jamb and hinge.

Moreover, as the leaves of the hinge are tapered, and are so constructed as to present only a single thickness of leaf when the hinge is closed, the hinge of this invention minimises the risk of a door binding against a door jamb. Thus it obviates the need for the edge of the door to be trimmed or bevelled. It will thus be appreciated that the hinges of this invention are particularly suited to metal doors and metal door frames. In addition, they are suitable for a wide range of applications for both doors, windows, and other fittings.

The hinges may be formed from any suitable material by any suitable means. Nevertheless, it will be generally convenient to cast the hinges from metal, e.g. zinc or aluminium, or to mould them from a reinforced plastics material, depending upon the size of the hinges, and the load they have to carry.

Finally, it will be appreciated that various alterations and modifications may be made to the foregoing without departing from the scope of this invention as exemplified by the following claims.

I claim:

1. A hinge having a pair of leaves that are pivotally interconnected for relative swinging movement by a removable pivot pin, one leaf being an outer leaf and having a pair of tubular portions at each end thereof for reception of said pivot pin and having a central cut out area for the reception of the other leaf which is an inner leaf having an inner tubular portion disposed between the tubular portions of said pair of tubular portions for reception of said pivot pin, the inner leaf fitting completely within the cut-out in the outer leaf when the hinge is closed, wherein the inner leaf does not extend beyond the outer leaf in any direction so as to present only a one leaf thickness when the hinge is closed, the thickness of the leaves decreasing progressively in a direction away from said pivot pin, said outer leaf having beveled edges about the perimeter of said cut out area that contact oppositely disposed beveled edges around the outer perimeter of said inner leaf, only said beveled edges of said inner and outer leaf fitting and abutting against each other when the hinge is closed, whereby the hinge can close to a one leaf thickness in only one orientation.

* * * * *